US006206142B1

(12) United States Patent
Meacham

(10) Patent No.: US 6,206,142 B1
(45) **Date of Patent: *Mar. 27, 2001**

(54) ELEVATOR ADVERTISING SYSTEM AND METHOD FOR DISPLAYING AUDIO AND/OR VIDEO SIGNALS

(76) Inventor: Nancy K. Meacham, P.O. Box 782085, Wichita, KS (US) 67278-2085

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/283,811

(22) Filed: Apr. 1, 1999

(51) Int. Cl.[7] ..... B66B 1/34
(52) U.S. Cl. ..... 187/392; 187/396; 187/394
(58) Field of Search ..... 187/391, 392, 187/396, 397, 394

(56) References Cited

U.S. PATENT DOCUMENTS 4,852,696 * 8/1989 Fukuda et al. ..... 187/139
4,995,479 * 2/1991 Fujiwara et al. ..... 187/135
5,056,629 * 10/1991 Tsuji et al. ..... 187/139
5,258,586 * 11/1993 Suzuki et al. ..... 187/124
5,606,154 * 2/1997 Doigan ..... 187/396
5,844,181 * 12/1998 Amo et al. ..... 187/396
5,955,710 * 9/1999 DiFranza ..... 187/396

* cited by examiner

*Primary Examiner*—Jonathan Salata
(74) *Attorney, Agent, or Firm*—Shook, Hardy & Bacon L.L.P.

(57) ABSTRACT

A system is provided for displaying an audio/video signal in an elevator car. The system includes a signal storage assembly for storing the audio/video signal to be displayed, a display supported on the elevator car for displaying the audio/video signal, and a sensor fixed to the elevator car for sensing a condition indicative of the presence of a user in the elevator car. A controller is also provided which is connected to the signal storage assembly and to the first sensor for initiating display of the audio/video signal in response to the sensed condition of the first sensor.

11 Claims, 1 Drawing Sheet

ELEVATOR ADVERTISING SYSTEM AND METHOD FOR DISPLAYING AUDIO AND/OR VIDEO SIGNALS

BACKGROUND OF THE INVENTION

The present invention relates generally to elevators and, more particularly, to an elevator apparatus incorporating a system for displaying an audio and/or video signal in response to a sensed condition in an elevator car.

It is conventional to construct a building with an elevator apparatus having a car suspended in a shaft by a plurality of cables for translational vertical movement between the floors of the building. The shaft includes a doorway at each floor, and a door that opens when the elevator car is positioned to load and unload passengers at the floor.

The car of a conventional elevator apparatus includes an interior compartment sized for receipt of several passengers, a doorway through which the passengers can board the car, and a door that opens when the elevator car is positioned at one of the floors of the building. The car also includes an input keypad that permits passengers to control operation of the elevator by inputting the floor numbers of the building at which stops are desired, stopping operation of the car, and signaling an emergency situation. A display is also provided for displaying the location of the car and the direction in which it is headed.

Sensors are provided on the elevator apparatus for sensing the location of the car, the direction of travel, and/or the presence of a passenger or other obstruction in the doorway of the car. These sensors are connected to the controller of the apparatus, which operates the elevator doors and the motor to move the car between floors and to allow the loading and unloading of passengers.

A technical problem unaddressed by the conventional construction resides in the inability in such apparatuses to deliver information to passengers of the elevator in an effective manner during travel between floors. Specifically, it would be desirable to display audio/video signals for passengers on an elevator car, whereby useful information, e.g. advertising or marketing information, could be conveyed to the passengers when the passengers are detected. In addition, it would be beneficial to tailor the signal displayed in the car to the location and direction of travel of the passengers in the building.

BRIEF SUMMARY OF THE INVENTION

It is an object of the present invention to solve the technical problems left unaddressed by conventional elevators, and to provide an elevator having a display system responsive to a sensed condition in the elevator for displaying an audio/video signal for passengers on the car.

In accordance with this and other objects of the invention evident from the following description of a preferred embodiment, an elevator is provided which includes a system for displaying an audio/video signal in an elevator car. The elevator includes a signal storage assembly for storing the signal to be displayed, a display supported on the elevator car for displaying the signal, a first sensor fixed to the elevator car for sensing a condition indicative of the presence of a user in the elevator car, and a controller operably connected to the signal storage assembly and to the first sensor for initiating display of the signal in response to the sensed condition of the first sensor.

By providing an elevator apparatus constructed in accordance with the invention, several advantages are realized.

For example, by providing a system that is capable of sensing the presence of a user on an elevator car, a change in weight of the car due to the presence of passengers, and/or the entry of a floor number in a keypad, it is possible to control the timing and content of the information displayed to the passenger. As such, the signal displayed can be tailored to the presence, location, and/or direction of travel of the passenger rather than being simply a continuous and repetitious loop of information that is always the same.

Another advantage realized from practice of the present invention resides in the use of a controller that initiates display of the signal only when a condition is sensed that indicates the presence of a passenger. This timed display eliminates unnecessary operation of the system when the car is unoccupied, and increases the useful life of the system relative to continuous loop playback systems.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 1:
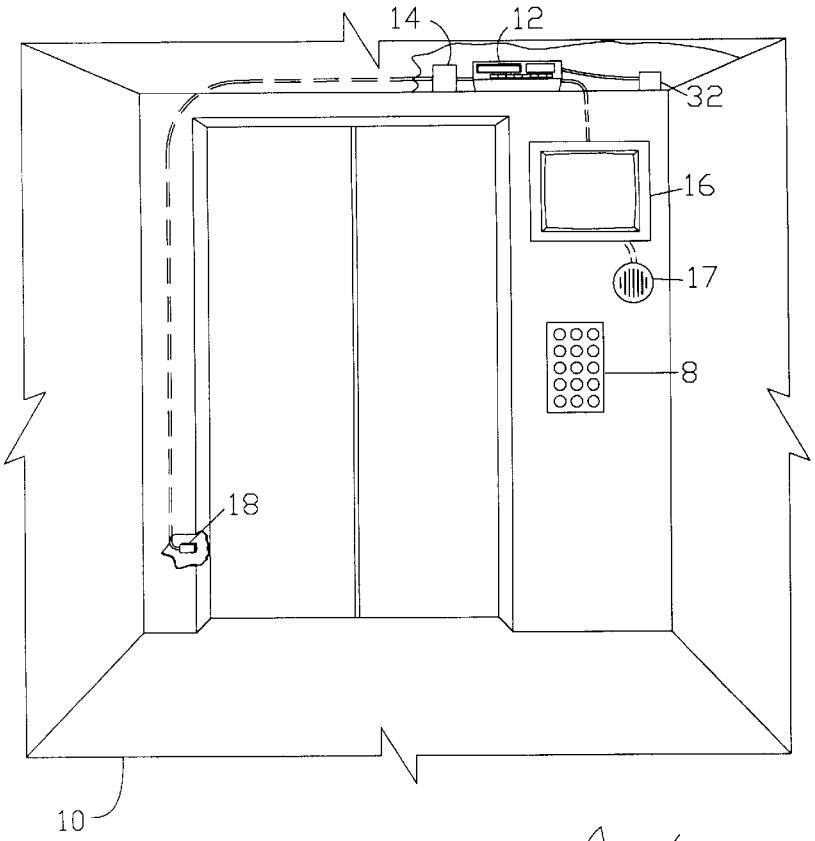
FIG. 1 is a schematic view of an elevator car and an audio/video signal display system constructed in accordance with the preferred embodiment of the invention.

Referring to FIG. 1, an elevator car forming a part of an elevator apparatus is depicted generally by numeral 10. As is conventional, the elevator apparatus is provided in a building presenting an elevator shaft, and the car 10 is suspended in the shaft by a plurality of cables for translational vertical movement between the floors of the building. The shaft includes a doorway at each floor, and a door that opens when the elevator car is positioned to load and unload passengers at the floor.

The car 10 includes an interior compartment sized for receipt of several passengers, a doorway through which the passengers can board the car, and a door that opens when the elevator car is positioned at one of the floors of the building. The car also includes an input keypad 8 that permits passengers to control operation of the elevator by inputting the floor numbers of the building at which stops are desired, a controller 14 for controlling operation of the apparatus in response to the signals inputted into the keypad, and a display for displaying the location of the car and the direction in which it is headed.

In accordance with the preferred embodiment of the present invention, the elevator apparatus also broadly includes a signal storage assembly 12, a display 16 for displaying an audio/video signal played back from the storage assembly, a speaker 17 associated with the display, a sensor 18 for detecting a passenger or other obstruction in the doorway of the elevator car, and a sensor 32 for detecting the location of the car in the building. In addition, a third sensor may be provided for detecting the direction of travel of the elevator car, or this condition can be signaled directly by the controller 14 based on the information inputted in the keypad.

The storage assembly 12 is operatively connected to the display on the elevator car, but can be physically mounted in any desired location. For example, the storage assembly can be mounted on the elevator car 10 near an access panel in the roof of the elevator car 10. This positioning allows easy access to the storage assembly 12. Further, the storage assembly can be constructed to store the audio/video signal in any desired format. For example it could store a digital format such as a compact disk, a digital video disk, or the like. Alternately, the assembly could store analog signals in a format such as video cassettes, films, tapes and the like. Although the only requirement of the storage assembly is that it be capable of storing and playing back an audio/video signal, it could possess a more complex construction and role in the apparatus. For example, the storage assembly could form a part of a computer or the like capable of functioning not only as the storage assembly, but also as a controller separate from the controller 14 for controlling just the operation of the system.

The signal stored by the storage assembly 12 can be any desired signal, and can include a single track of information or multiple tracks. For example, it is possible to store a single track of information that is played back or displayed every time the controller initiates operation of the storage assembly, or different tracks can be played depending on the location and/or direction of travel of the elevator. Likewise, different tracks can be played back in a random order such that frequent passengers of the elevator car are always exposed to messages in a unique order.

The content of the signals presented by the system can include any subject matter desired, and the invention is not limited in this respect. For example, it is possible to include advertising, promotional information, news, still images, photographs, moving pictures and any other type of information capable of being displayed. One particularly useful type of material that can be presented is advertising directed to particular products or services provided in the building in which the elevator is located. This would allow a promoter to select information about merchandise sales or events and even which floor that merchandise or event can be found. In addition to promotional materials as a courtesy, the user could view news clips and other information on current events.

The controller 14 is operably connected to the storage assembly 12, and can be physically located in any desired location, either near to or remote from the storage assembly and elevator car. Preferably, the controller 14 is the same controller as is used to operate the elevator car in response to the sensors and to the information inputted into the keypad by passengers. However, a separate controller could be provided that operates just the signal storage assembly, if desired. As such, it would be possible to retrofit the system in an existing elevator apparatus. The controller functions to control the timing of playback of the signal, as well as the selection of the signal where more than one track or piece of information is stored or input at a time.

The display 16 is a monitor or like display, and is physically supported on or within the elevator car for travel therewith within the elevator shaft such that the display is visible and the speaker 17 is audible by passengers in the car as they are carried between the floors of the building.

The monitor could also be constructed from a passive or active matrix construction, or from any other design capable of displaying a video signal played back from the storage assembly 12. The display 16 is operably connected to the storage assembly, and permits the signal from the assembly to be displayed in response to activation of the playback by the controller 14. The preferred method of connection would be through a cable. However, any other conventional means of transmitting the signal between the two points may be used without departing from the scope of the present invention as recited in the claims.

Although it is possible to provide a display separate from the existing display in the elevator car used for displaying the location and direction of the car, it is also possible to use the single display 16 to display both the car information, i.e. the location and direction of the car, as well as the signal from the storage assembly. As such, passengers could simply view the single display to receive all of the information provided in the car.

The sensor 18 is preferably a conventional sensor fixed in the doorway of the car or shaft of the elevator apparatus for sensing the presence of a passenger or other obstruction in the doorway. For example, the sensor 18 could be an optical sensor having an emitter and a receiver, wherein the emitter directs an optical signal across the doorway of the car that is broken when a passenger enters or exits the car. Preferably, the sensor 18 is the same sensor that is used to control operation of the doors of the elevator apparatus. However, a separate sensor could be employed, if desired. Alternately, the sensor could be a weight detector that detects a difference between the weight of the car when passengers are present in the car and the weight of the empty car. In either case, the sensor 18 senses the presence of a passenger on the car, and is able to convey this condition to the controller 14.

The sensor 18 is connected to the controller, and provides an indication that passengers are entering or exiting the car, signaling the controller 14 to begin playback of the signal. Likewise, the condition sensed by the sensor 18 may be used to signal the stoppage of playback, or the switching of playback from one track of material to another.

A second sensor 32 is utilized to sense the floor location of the elevator car, and is preferably the same sensor as is used by the controller 14 of the apparatus to control movement of the car. Conventionally, the sensor provides a signal to the controller that permits the floor location to be displayed on a display panel of the elevator car so that passengers are aware of their location in the building at any given time. However, the signal from the second sensor 32 may also be used by the controller to select one or more tracks of the signal for playback depending on the location of the car. For example, if the car is located on the first floor of the building, a first track of the signal may be played, and if the car is on the top floor, a different signal might be played.

As mentioned above, another embodiment includes another sensor operably connected to the floor selection keypad 8 of the elevator car. The sensor allows the controller to initiate playback of tracks of the signal based on the floor selections made by the passengers. Thus, not only would the sensor provide an indication that a passenger is on the car, but it would also provide information concerning the destination of the passenger so that the playback could be tailored to that destination. For example, the signal could include promotions, sales, and items found on those floors. Likewise, if consecutive floors are selected such that frequent stops were to be made, shorter tracks could be selected than if only relatively few floors were selected.

Yet another type of input capable of use with the controller includes that of a sensor used to detect the direction of travel of the car. It is conventional to provide lighted arrows or other indicators in the car for indicating to the passengers the direction of travel of the car. Control of the arrows is provided by the elevator controller, and this signal could also be used to control playback of the signal on the display of the system. For example, if the elevator car is going up, the tracks selected could provide information about the services offered in the building. Likewise, if the elevator is going down, the tracks selected could thank the passengers for their patronage.

In use, the controller 14 detects the condition of any one or all of the various types of sensors described herein, depending on which of the sensors is installed in the apparatus, and determines if a passenger is present on the car. This is done by sensing the passage of a passenger or obstruction past the doorway, sensing a change in the weight of the car and/or sensing the entry of a floor number in the keypad 8. In addition, the controller senses the location and direction of travel of the car. Based on the sensed condition (s), the controller initiates playback of a track of the signal, wherein the particular track cued depends on the conditions sensed. The preselected track is then played back on the display 16 for viewing by the passengers.

Figure 2:
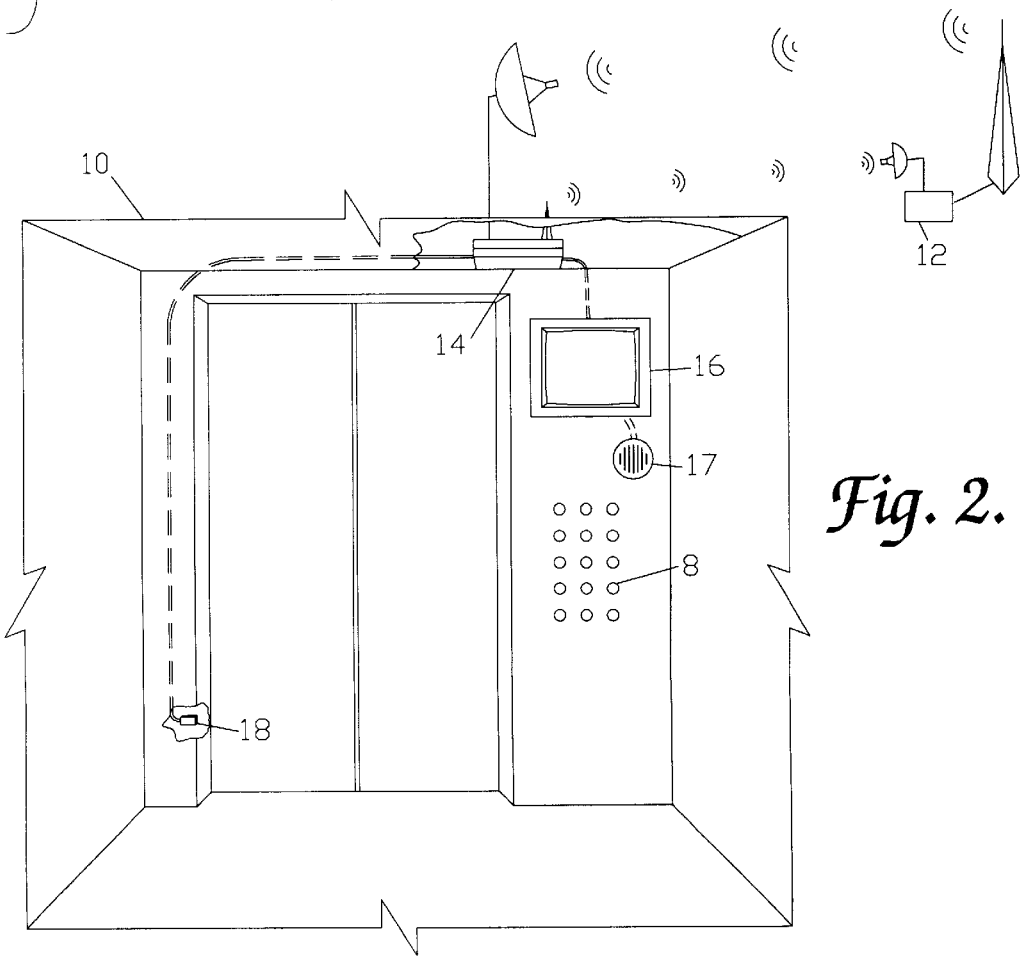
FIG. 2 is a schematic view of an elevator car and an audio/video signal display system constructed in accordance with an alternative embodiment of the invention.

FIG. 2 illustrates a second embodiment of the present invention where the storage assembly 12 is located at a remote location. This remote location can be anywhere other than on the elevator car 10. For example, storage assembly 12 could be in another part of the building, or in another location entirely. This second embodiment utilizes wireless transmission of any conventional construction, and includes receivers and transmitters known to one skilled in the art to send and receive messages between the controller and the storage assembly.

From the foregoing, it will be seen that this invention is one well-adapted to attain all the ends and objects hereinabove set forth, together with other advantages which are obvious and which are inherent to the structure. It will be understood that certain features and subcombinations are of utility and may be employed without reference to other features and subcombinations. This is contemplated by and is within the scope of the claims since many possible embodiments may be made of the invention without departing from the scope thereof It is to be understood that all matter herein set forth or shown in the accompanying drawings is to be interpreted as illustrative and not in a limiting sense.

What is claimed is:

1. A system for displaying an audio/video signal in an elevator car having a door and being movable between floors of a building, the system comprising:

a signal storage assembly for storing the signal to be displayed, wherein the signal includes two or more tracks of information;

a display supported on the elevator car for displaying the signal;

a first sensor for sensing a condition indicative of the presence of a user in the elevator car, wherein the first sensor detects the difference between the weight of the elevator car when empty and the weight of the elevator car when a passenger is present; and a controller operably connected to the signal storage assembly and to the first sensor for initiating display of the signal in response to the sensed condition of the first sensor, wherein the controller displays the two or more tracks of information in random order without regard to the identity of occupant or time of day.

2. The system as claimed in claim 1, wherein the signal storage assembly is a computer hard drive.

3. The system as claimed in claim 1, wherein the signal storage assembly is a compact disc player.

4. The system as claimed in claim 1, wherein the storage assembly is a video cassette player.

5. The system as claimed in claim 1, wherein the display is a monitor.

6. The system as claimed in claim 1, wherein the display includes a speaker.

7. The system as claimed in claim 1, wherein the first sensor includes an optical sensor directed across the door of the elevator car so that the condition sensed is of a person passing through the door.

8. The system as claimed in claim 1, wherein the elevator car includes a keypad including a plurality of floor selection buttons for controlling operation of the apparatus, and the first sensor senses activation of the floor selection buttons.

9. The system as claimed in claim 1, further comprising a second sensor for sensing the location of the elevator car in the building.

10. The system as claimed in claim 1, wherein the controller is remote from the elevator car.

11. The system as claimed in claim 1, wherein the storage assembly is remote from the elevator car.

* * * * *